US005348086A

United States Patent [19]

Trout

[11] Patent Number: 5,348,086

[45] Date of Patent: Sep. 20, 1994

[54] COMBINATION DOWNHOLE TOOL

[76] Inventor: Randall L. Trout, Rte. 5, Box 131, Weatherford, Okla. 73096

[21] Appl. No.: 956,164

[22] Filed: Oct. 5, 1992

[51] Int. Cl.[5] ..... E21B 31/00

[52] U.S. Cl. ..... 166/99; 166/173; 166/174

[58] Field of Search ..... 166/99, 311, 173, 174

[56] References Cited

U.S. PATENT DOCUMENTS

| | | | |
|---|---|---|---|
| 1,968,282 | 7/1934 | Cavins | 294/86 |
| 2,090,616 | 8/1937 | Erwin | 294/86 |
| 2,124,772 | 7/1938 | Flury | 166/99 |
| 2,359,717 | 10/1944 | Myers | 166/5 |
| 2,663,370 | 12/1953 | Donnell et al. | 166/99 |
| 2,670,930 | 3/1954 | Farrar | 166/99 |
| 2,675,879 | 4/1954 | Middleton et al. | 166/99 |
| 2,696,257 | 12/1954 | Clark | 166/99 |
| 2,830,663 | 4/1958 | Kirby, II | 166/65 |
| 2,908,332 | 10/1959 | Nedow | 166/99 |
| 2,929,452 | 3/1960 | Alexander | 166/103 |
| 3,007,525 | 11/1961 | Orr | 166/170 |
| 3,406,757 | 10/1968 | Baumstimler | 166/99 |
| 3,651,867 | 3/1972 | Baumstimler | 166/99 |
| 3,785,690 | 1/1974 | Hutchinson | 166/99 |
| 3,814,180 | 6/1974 | Oliver | 160/99 |
| 4,703,804 | 11/1987 | Stokes et al. | 166/311 |

*Primary Examiner*—Ramon S. Britts
*Assistant Examiner*—Frank S. Tsay
*Attorney, Agent, or Firm*—Dougherty, Hessin, Beavers & Gilbert

[57] ABSTRACT

A combination clean-out and fishing tool for use under rotary power in a well bore. The tool is adapted for connection to the drill string by means of an elongated connector sub. The connector sub then carries a cylindrical sleeve thereon which houses a cylindrical hub secured within the sleeve by means of shear pins. A cylindrical extension then secures below the cylindrical sleeve to support a clean-out tool of selected type therebelow while the hub and extension sub carrying a selected fishing tool are inside the cylindrical extension. After rotary operation of the clean-out tool to expose the fish, sufficient weight jarring the drill stem shears the shear pins to lower the connector sub, hub, extension sub and fishing tool into rotary engagement with the fish.

7 Claims, 3 Drawing Sheets

COMBINATION DOWNHOLE TOOL

BACKGROUND OF THE INVENTION

1. Field of the Invention

The invention relates generally to rotary downhole tools and, more particularly, but not by way of limitation, it relates to a combination downhole tool which can be used for clean-out and subsequent fishing with a single entry into the hole.

2. Description of the Prior Art

The prior art includes numerous types of downhole tools used for both clean-out and various fishing operations and there have even been some prior attempts at combination-type tools. The U.S. Pat. No. 2,929,452 discloses a combination tool wherein the tool is attached to the rotary drill string and includes a lower shoe of cylindrical shape having an appropriate bottom cutting edge for clearing out around the fish and drill pipe at a designated depth. In addition, the clean-out tool includes a fishing tool within that consists of a tubular, small diameter drill rod that is slidably retained within the clean-out or washover cylinder. U.S. Pat. No. 2,830,663 discloses a permanent magnet fishing tool of a type wherein the tool includes a lower cutting ring for clearing out around the fish and for bringing an axially aligned permanent magnet into contact to retain the fish for drawing upward.

Yet another type of combination tool is shown in U.S. Pat. No. 2,090,616 wherein the lower, circular cutting edge of the tool coacts with a suction-type fishing tool. U.S. Pat. No. 1,968,282 is a form of fishing tool that also operates on the suction principle and it also includes a toothed foot or shoe which serves to cut around the fish and to position the fish for uptake.

Summary of the Invention

The present invention relates to a downhole tool having the combined capabilities of cleaning out and more clearly exposing a fish and thereafter stabbing or seizing the fish for removal from the borehole, all in a single trip operation. The tool consists of an elongated, tubular connector sub having a box end for connection to a drill string with a cylindrical sleeve slidingly received upward over the sub bottom end. A cylindrical hub is placed up within the cylindrical sleeve also to receive the connector sub lower end downward therethrough for connection to an extension sub that serves to support a selected fishing tool therebelow. An extension sleeve is then connected around the entire assembly and threadedly received on the lower end of the cylindrical sleeve, and a selected type of clean-out tool is threadedly received on the lower end of the extension sleeve. The hub is held within the cylindrical sleeve during clean-out rotation by a vertical spline connection and a plurality of radial shear pins maintaining the hub in position. Upon addition of sufficient drill string weight and shearing of the pins, the connector sub lower end, the cylindrical hub and the extension sub carrying the fishing tool are allowed to descend into the fish and continued rotation positively engages the fish.

Therefore, it is an object of the present invention to provide a clean-out and fishing tool that can be employed with but a single trip of the drill string.

It is also an object of the present invention to provide a combination-type fishing tool that enables use of a selected one of the clean-out tool and the fishing tool.

It is yet a further object of the present invention to provide a downhole tool of a combination type that is relatively simple yet reliable in operation.

Finally, it is an object of the present invention to provide a combination clean-out and fishing tool which is utilized with a minimum number of trips of the drill string thus enabling a great savings in time and labor.

Other objects and advantages of the invention will be evident from the following detailed description when read in conjunction with the accompanying drawings which illustrate the invention.

DETAILED DESCRIPTION OF THE INVENTION

Figure 1:
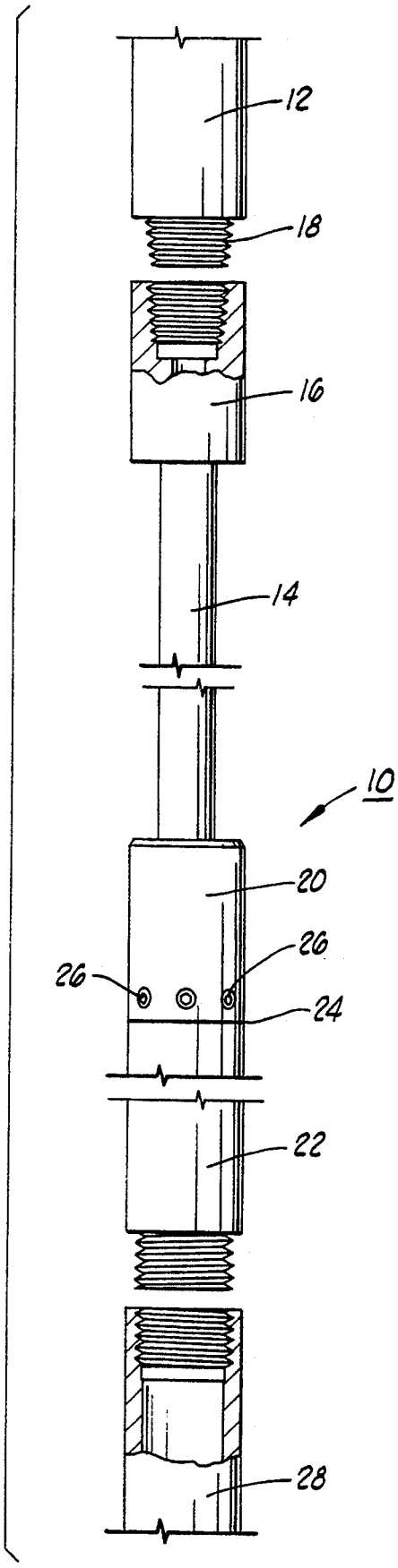
FIG. 1 is a view in elevation of the combination tool as it is assembled on a drill string.

As shown in FIG. 1, the combination tool 10 receives rotation from connection to drill string 12, either drill collar or drill pipe. Thus, an upper connector sub 14 has a threaded box end 16 for secure attachment to threads 18 of drill string 12. The connector sub 14 is slidably received into a cylindrical sleeve 20 as connector sub 14 supports the fishing tools within an extension sleeve 22 threadedly connected to cylindrical sleeve 20 at joint 24, as will be further described below. A selected plurality of shear pins 26 coact with interior fishing tool elements within cylindrical sleeve 20, as will be further described.

Shown generally is a clean-out tool 28 which is threadedly received at the lower end of extension sleeve 22. The length of tool 28 may vary and this tool can be such as an overshot, wash pipe, burn-shoe, wash-over shoe and the like. The second tool or fishing tool is maintained in standby position by means of the shear pins 26 within the extension sleeve 22 until actuated to the fishing mode, as will be described.

Figure 2:
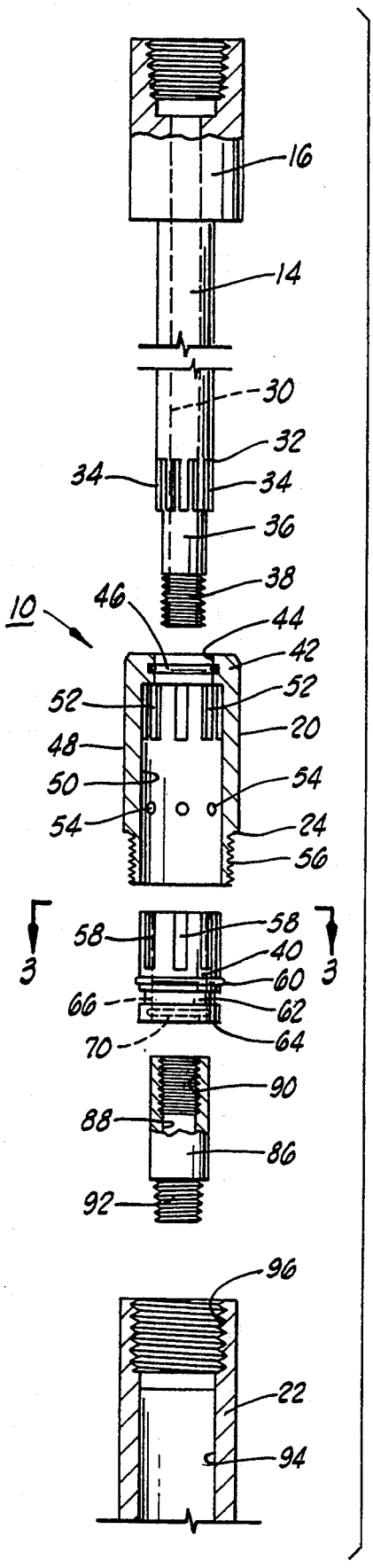
FIG. 2 is an exploded view of the tool with selected components shown in vertical section.

Referring now to FIG. 2, the connector sub 14 is a tubular member having an interior bore 30 and terminating at a lower annular shoulder 32 with a circumferal array of equally spaced splines 34 leading into a reduced diameter tubing 36 that terminates in lower threads 38. The outside surface of connector sub 14 above shoulder 32 should be a smooth, polished surface and it is suggested that it be chrome plated in order to provide good seating against the elastomer seal members in cylindrical sleeve 20, as will be further described. The splines 34 are formed longitudinally of sub 14 and there may be, for example, eight such splines 34 for interlocking connection with grooves within a cylindrical hub 40, to be described.

Cylindrical sleeve 20 includes an end wall 42 defining an axial bore 44 having a plurality of elastomer seals 46 seated therearound. Seals 46 ride on the polished surface of connector sub 14. End wall 42 then forms into an outer side wall 48 and an inner side wall 50 having a plurality of splines 52 is formed around the upper end thereof. Sleeve 20 also has a circumferal array of threaded holes 54 for receiving jacketed shear pins 26, and lower threads 56 interconnect with the extension sleeve 22.

The cylindrical hub 40 includes an upper portion having a plurality of longitudinal grooves 58 sized for mating engagement with the plural splines 52 up within cylindrical sleeve 20. The lower portion of hub 40 includes a groove and sealing ring 60 for sealing contact with the inner sidewall 50 of cylindrical sleeve 20, and an annular groove 62 for receiving the inner ends of shear pins 26 (to be described). The hub 40 terminates in lower surface 64.

Figure 3:
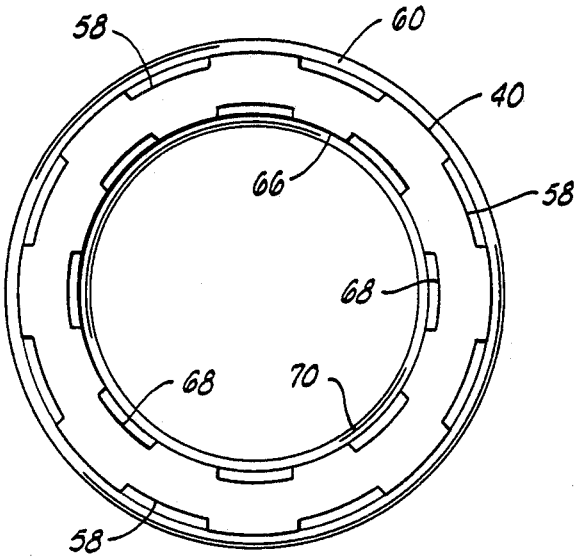
FIG. 3 is a cross-section taken along lines 3—3 of FIG. 2.

Referring to FIG. 3, the outer surface of hub 40 includes the plurality of longitudinal grooves 58, and axial hole 66 down through hub 40 includes a plurality of longitudinal, equally spaced grooves 68 which matingly engage splines 34 of connector sub 14 when the tool 10 is in its fully assembled condition. Referring again to FIG. 2, the lower portion of bore 66 includes a groove and sealing ring 70 which seals against tubing surface 36 of connector rod 14 when assembled.

Figure 4:
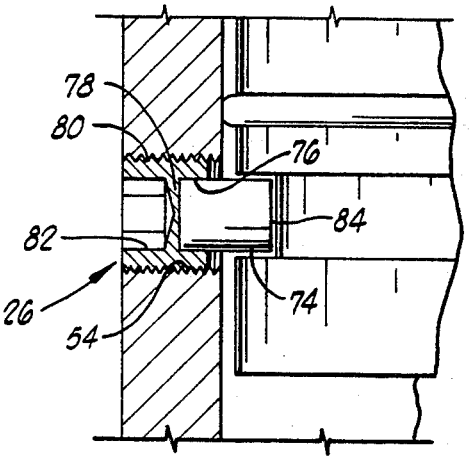
FIG. 4 is a sectional view of a shear pin as used in the present invention.

FIG. 4 illustrates the type of shear pin 26 positioned within threaded bores 54. A standard type of shear pin 74 is selected for type of material, diameter and hardness for use in a given shearing application, and a calculation of this shear pin rating times the number of circumferal shear pins 74 can be preselected to provide the operator with a breaking point so that he will know how much weight must be placed on the drill stem to effect shear. Each shear pin 74 is then disposed in an axial bore 76 of a steel jacket 78 having threads 80 and an allen wrench insert 82. In the assembled condition of tool 10, the inner end 84 of shear pin 74 seats within the semi-circular groove 62 of cylindrical hub 40 to secure the hub up within cylindrical sleeve 20 with all spline/-grooves engaged.

An extension sub 86 is formed with an interior bore 88 that includes threads 90 at the upper portion thereof for receiving the lower threads 38 of connector rod 14. The diameter of sub 86 is slightly greater than the diameter of bore 66 of cylindrical hub 40 and, therefore, sub 86 tends to support hub 40 upward when in the assembled condition. Lower threads 92 of extension sub 86 provide connection to a suitable fishing tool. The fishing tool may be selected from any of magnet, impression block, spear type, taper tap, overshot, junk baskets or the like depending upon the exigencies of the particular fishing operation. The extension sleeve 22 having interior bore 94 and interior threads 96 then aligns over the fishing tool assembly and secures onto threads 56 of cylindrical sleeve 20 in the manner shown in FIG. 1. The extension sleeve 22 may be selected to be of pre-set length, again depending upon the job, and it includes bottom threads (FIG. 1) for receiving the selected clean-out tool 28, as previously described.

In operation, the combination tool 10 is first assembled at the surface and threaded onto the adjacent drill collar or drill pipe of the drill string 12 whereupon the tool is taken downhole. In assembly, the connector sub 14 is inserted through the axial bore 44 of cylindrical sleeve 20 as the cylindrical hub 40 is inserted upward within sleeve 20. Hub 40 is seated upward with splines 52 aligned in grooves 58, and the plurality of shear pins 26 are inserted within threaded bores 54 as inner ends 84 seat against the annular groove 62. Thereafter, the splines 34 of connector sub 14 will be seated within the central grooves 68 of hub 40 (see FIG. 3) and the connector sub lower threads 38 are received within threaded bore 90 of extension sub 86.

The selected fishing tool is then secured on threads 92 of extension sub 86, and the extension sleeve 22 of selected length is threadedly connected over the fishing tool to the lower threads 56 of cylindrical sleeve 20. In this manner the extension sleeve 22 effectively houses the fishing tool while also receiving a designated clean-out tool 28 (FIG. 1) affixed to its lower threaded end. Thus, with rotation being provided by the drill string 12, the clean-out tool at the bottom of combination tool 10 is made to rotate and clean out around the fish. When the fish is sufficiently aligned or exposed, the operator can place a predetermined amount of extra weight on the drill string thereby shearing the pins 74 within threaded bores 54 of sleeve 20 and allowing the connector sub 14, hub 40, extension sub 86 and the selected fishing tool to proceed downward, still rotating, for engaging the tool in the designated fish. When attachment is complete, the entire drill string and tool can be withdrawn while also drawing up the fish as an aid in clearing the bore.

Figure 5A:
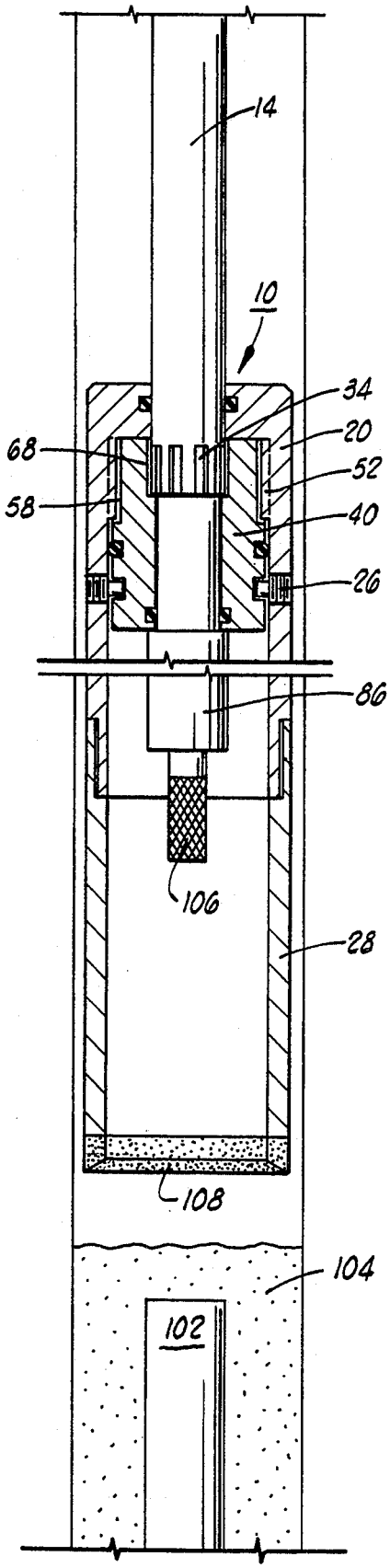
FIG. 5A is an idealized representation of the tool in the clean-out mode.
Figure 5B:
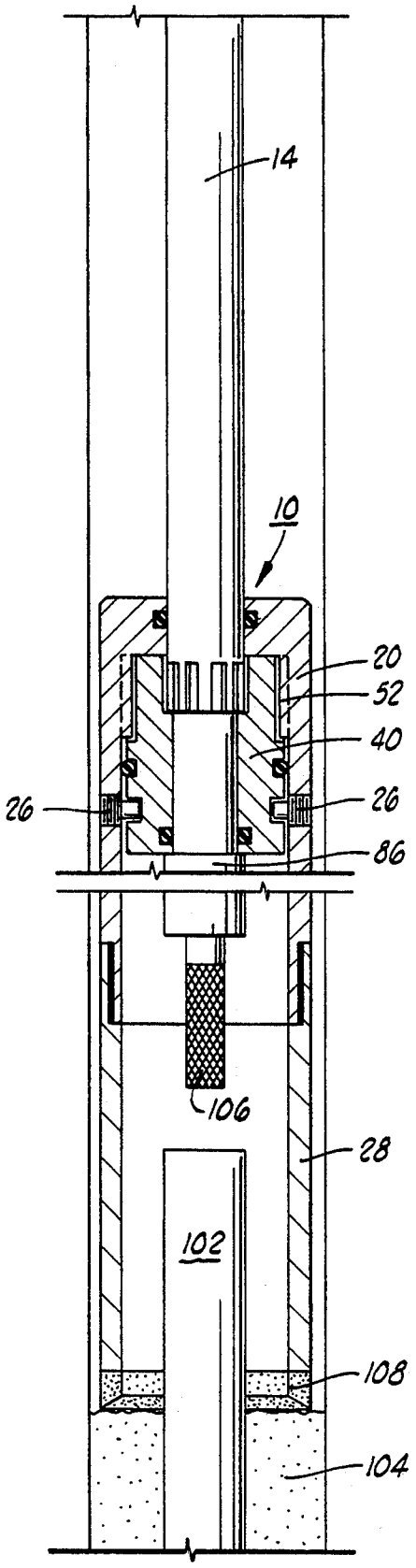
FIG. 5B is an idealized representation of the combination tool in an intermediate attitude wherein the shear pins have been sheared and the fishing tool descends.
Figure 5C:
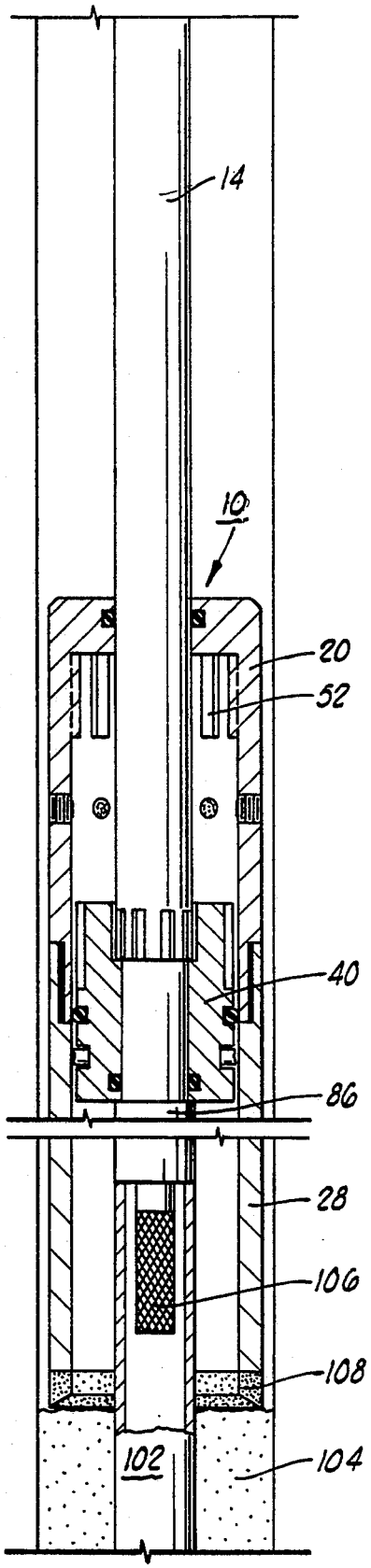
FIG. 5C is an idealized representation of the combination tool with the fishing tool engaged with the fish.

FIGS. 5A, 5B and 5C illustrate in idealized form, three successive attitudes of the combination tool 10 as it operates in the pre-engagement mode as shown in FIG. 5A, in the clean-out mode as shown in FIG. 5B, and as shown in FIG. 5C in the fishing mode with the fishing tool engaged.

FIG. 5A illustrates the combination tool 10 in assembled form as it is suspended from connector sub 14 within the well annulus adjacent the debris or fill 104 that conceals the fish 102. In the initial assembled form, the cylindrical sleeve 20 is aligned on connector sub 14 and cylindrical hub 40 is inserted over the lower end of connector sub 14 as extension sub 86 is threadedly secured on lower threads 38 of connector sub 14. The assembled hub 40 is then maintained up within cylindrical sleeve 20 by a plurality of threaded shear pins 26. The splines 32 on connector sub 14 mate with grooves 68 in central bore 66 of hub 40 (see FIG. 3). The splines 52 around the inner wall of cylindrical sleeve 20 matingly engage the grooves 58 around the outer circumference of hub 40. The selected type of fishing tool 106 is then threadedly received in the lower end of extension sub 86.

The combination tool 10 then receives rightward rotation from the drill string as it is lowered into engagement with the cutting bottom formation 108 of clean-out tool 28 contacting the fill material 104 and loosening the fill material such that return flow of the drilling fluid as delivered down through the drill string and connector sub 14 and tool elements, carries the cut material up the annulus for surface disposal. FIG. 5B illustrates the condition where the combination tool 10 has progressed downward sufficiently to expose a portion of fish 102. At this point, the operator then places a predetermined amount of weight on the drill string, an amount sufficient to shear the plurality of threaded shear pins 26 thereby to allow the internal assembly within cylindrical sleeve 20 to drop so that the fishing tool 106 comes into engagement with the fish 102. The amount of weight required for shearing of the shear pins 26 is a pre-planned amount in accordance with the size and type metal of the particular shear pins employed.

Referring to FIG. 5C, when the fishing tool 106 descends and engages fish 102 there is continued rotation rightward of connector sub 14 and elements connected therebelow such that rotation is transmitted through extension sub 86 to the fishing tool 106 as it threadedly engages the fish 102. When sufficient grip is apparent, e.g., after a predetermined number of engaged revolutions of fishing tool 106, the entire drill string can be withdrawn from the hole with final extraction of the connector sub 14, combination tool 10, and the fish 102 brought up from its interfering position.

The foregoing discloses a novel form of combination-type clean-out tool with fishing tool, a unique combination that enables most fishing operations to be carried out with a minimum number of trips required. Thus, the tool is a great time-saver which can result in considerable labor savings in a well operation.

Changes may be made in the combination and arrangement of elements as heretofore set forth in the specification and shown in the drawings; it being understood that changes may be made in the embodiments disclosed without departing from the spirit and scope of the invention as defined in the following claims.

What is claimed is:

1. A combined clean out and fishing tool for downhole use with a rotational drill string, comprising:

an elongated, tubular connector sub having a threaded box end on the upper end and threads on the lower end with said box end axially secured to said drill string;

a cylindrical sleeve having an inner sidewall and upper end wall having an axial hole receiving said connector sub lower end slidingly therethrough;

a generally cylindrical hub having a central bore and being slidably secured up within said cylindrical sleeve and receiving said connector sub lower end downward therethrough;

a circumferential array of shear pins retained in said cylindrical sleeve and securing said cylindrical hub;

an extension sub secured beneath the hub to the connector sub threaded lower end;

a selected fishing tool connected to extend axially down from said extension sub;

an extension sleeve connected to the cylindrical sleeve and extending down over the fishing tool; and a selected clean out tool connected in axial alignment to said extension sleeve;

whereby a predetermined increase in drill string weight causes separation of the cylindrical hub from the cylindrical sleeve to allow the connector sub, cylindrical hub, extension sub and fishing tool to move downward into rotational engagement.

2. Apparatus as set forth in claim 1 which is further characterized to include:

a circumferal array of splines formed inside of said cylindrical sleeve;

a circumferal array of grooves formed around the cylindrical hub for mating engagement with said splines in said cylindrical sleeve; and an annular groove formed around said cylindrical hub to receive said shear pins in seizing engagement.

3. Apparatus as set forth in claim 1 which is further characterized to include:

a circumferal array of splines formed adjacent the lower end of the connector sub; and a circumferal array of grooves formed around the central bore of said cylindrical hub for mating engagement with said circumferal array of splines in the lower end of the connector sub.

4. Apparatus as set forth in claim 2 which is further characterized to include:

a circumferal array of splines formed adjacent the lower end of the connector sub; and a circumferal array of grooves formed around the central bore of said cylindrical hub for mating engagement with said circumferal array of splines in the lower end of the connector sub.

5. Apparatus as set forth in claim 1 which is further characterized to include:

a polish finish on said tubular connector sub; and an elastomer seal disposed in said axial hole of the cylindrical sleeve for continually contacting said tubular connector sub polish finish.

6. Apparatus as set forth in claim 4 which is further characterized to include:

a polish finish on said tubular connector sub; and an elastomer seal disposed in said axial hole of the cylindrical sleeve for continually contacting said tubular connector sub polish finish.

7. A borehole clean out and fishing tool for use on a drill string, comprising:

a connector sub including a threaded box end, and a length of polish pipe having an axial bore and first splines around a lower threaded end;

a cylindrical sleeve having an inner sidewall and end wall with axial hole, and concentric seal means surrounding said hole such that said polish pipe fits slidingly sealed within said hole and seal means, the sleeve defining a cylindrical cavity with second splines formed around the upper periphery;

a cylindrical hub having a central bore with first grooves spaced around the outer circumference and second grooves spaced around the central bore, said hub being received up within the cylindrical sleeve with first grooves engaging said second splines while said connector sub first splines are engaged with the second grooves;

a plurality of shear pins of selected shear resistance disposed through the cylindrical sleeve sidewall into the cylindrical hub;

an extension sub disposed below said hub central bore for threaded connection to said connector sub first end;

a selected fishing tool secured to extend axially from said extension sub;

an extension sleeve threadedly connected to said cylindrical sleeve and normally extending down over the fishing tool; and a clean out tool secured to extend downward from said extension sleeve;

whereby drill string rotation will be transmitted through to the clean out tool until the drill string weight is increased sufficiently to shear the shear pins whereupon the drill string drops downward until the fishing tool is engaged and rotation can recommence.

* * * * *